US009136645B1

(12) United States Patent
Yu

(10) Patent No.: US 9,136,645 B1
(45) Date of Patent: Sep. 15, 2015

(54) STRUCTURE OF PLUG, SOCKET CONNECTOR AND THE COMBINATION THEREOF

(71) Applicant: T-CONN PRECISION CORPORATION, New Taipei (TW)

(72) Inventor: Chien-Yi Yu, Taipei (TW)

(73) Assignee: T-Conn Precision Corporation, Taipei (TW)

( * ) Notice: Subject to any disclaimer, the term of this patent is extended or adjusted under 35 U.S.C. 154(b) by 0 days.

(21) Appl. No.: 14/281,903

(22) Filed: May 20, 2014

(30) Foreign Application Priority Data

Apr. 30, 2014 (TW) ..... 103207528

(51) Int. Cl.
*H01R 4/50* (2006.01)
*H01R 13/627* (2006.01)
*H01R 13/24* (2006.01)

(52) U.S. Cl.
CPC ..... *H01R 13/6273* (2013.01); *H01R 13/2407* (2013.01)

(58) Field of Classification Search
CPC ..... H01R 13/625; H01R 13/6278; H01R 12/724; H01R 13/658; H01R 13/73; H01R 13/514; H01R 13/2407; H01R 13/6273
USPC ..... 439/346
See application file for complete search history.

(56) References Cited

U.S. PATENT DOCUMENTS

| | | | | |
|---|---|---|---|---|
| 6,939,158 | B2 * | 9/2005 | Moffett et al. | 439/346 |
| 7,056,141 | B2 * | 6/2006 | Moffett et al. | 439/346 |
| 7,476,108 | B2 * | 1/2009 | Swain et al. | 439/79 |
| 7,726,982 | B2 * | 6/2010 | Ngo | 439/79 |
| 7,789,673 | B2 * | 9/2010 | Lee et al. | 439/74 |
| 8,087,942 | B2 * | 1/2012 | Chen | 439/74 |
| 2010/0178790 | A1 * | 7/2010 | Bright et al. | 439/346 |

* cited by examiner

*Primary Examiner* — Jean F Duverne

(57) ABSTRACT

The present invention is an improved structure of plug, socket connector and the combination thereof. The plug and socket connectors may butt mutually, and both comprise a insulating frame provided with multiple hook buckles and heat dissipation holes; multiple power terminals provided in the insulating frame in an one to one correspondence match, each of the power terminals being joined with hook hole and hook buckle; and multiple signal terminals joining with the insulating frame; wherein one end of each of the power terminals of the plug connector is provided with multiple elastic clips, and the other end thereof and one side of each of the elastic clips are provided with two heat sinkers, respectively, while each of the power terminals of the socket connector is provided with a heat sinker on the rear end thereof, respectively. Thereby, each of the power terminals is allowed to join with the hook buckle of the insulating frame with the hook hole in order to prevent from looseness, and the elastic clips of each of the power terminals provided by the plug connector after the plug and the socket connector butt together may be used to increase solid contact points and area in order to reduce resistance of the contact points, and the heat dissipation capability during operation is enhanced with the heat sinkers of each of the power terminals. In addition, the convection is improved by the heat dissipation holes and the heat dissipation channel opened by each insulating frame.

12 Claims, 12 Drawing Sheets

STRUCTURE OF PLUG, SOCKET CONNECTOR AND THE COMBINATION THEREOF

BACKGROUND OF THE INVENTION

1. Field of the Invention

The present invention is an improved structure of plug connector, socket connector and the combination thereof, and particularly relates to a plug and a socket connector for transmission of power lines or signal lines.

2. Descriptions of the Related Art

It is known that the plug connector, the socket connector and the combination thereof of Taiwan patent No. M420094 (as shown in FIG. 11) include a plug connector and a socket connector. Both of the plug connector and the socket connector include a seat and a plurality of terminals. The seat is provided with a butting portion and a plurality of containing troughs extending between separation plates and neighbored separation plates behind the butting portion. Each of the containing troughs is penetrated and positioned with a plurality of terminals therein. Each of the terminals is provided with two slabs with a gap therebetween. Two sides of the slabs are extended with butting ends and welding portions extending downwards on the opposite sides. Upper, lower sides of the slabs are provided with bending sheets for heat dissipation bending toward opposite slabs. Also, more bending sheets could be arranged as need for increase of heat dissipation area in order to improve the effect of heat dissipation.

The power connector component and the connector therein disclosed in another Taiwan patent No. I350621 (as shown in FIG. 12) include a mutually matched socket connector and plug connector. The plug connector includes a plug insulation body, which is provided with a bulk portion for receiving terminals. The bulk portion is provided with a terminal receiving channel for receiving terminals. A male terminal set is received in the terminal receiving channel. The socket connector includes a socket insulation body, which is provided with a terminal receiving channel which receives terminals. A female terminal set is received in the terminal receiving channel. The socket insulation body is provided with a butting cavity receiving matching part of the plug insulation body. The female terminal set is used for adaptation with the male terminal set. Wherein, a convection channel is formed between the outer surface on the bulk portion of the plug insulation body and the inner wall of the butting cavity of the socket insulation body. The outer surface on the plug insulation body is formed with a positioning rib. The positioning rib extends forwards from the front end of the bulk portion to form a positioning block, which abuts against a corresponding wall of the butting cavity of the socket insulation body. Multiple convection channels are provided to realize the heat dissipation effect.

Although above prior arts claim that they could achieve good heat dissipation effect, the real cases do not agree because there is no hole for gas convection (or dissipation) arranged on the socket connector and plug connector of the two patents. Therefore, whenever heat is generated during operate, the heat would circulate inside the socket connector and plug connector continuously, such that effective heat dissipation is impossible and the utilization performance is impacted accordingly. In addition, after the socket connector and plug connector are connected, the resistance between the terminals becomes larger because surface contact structure is adopted for mutually butted terminals. Thereby, heat generation gets serious on the joint surface between the socket connector and the plug connector.

In view of above, the inventor of the invention has made efforts to study and develop an improved plug, socket connector and the combination structure thereof in order to improve the shortages of above problems.

SUMMARY OF THE INVENTION

The major objective of the present invention is in that a hook hole may be used for each of the power terminals to join with a hook buckle of an insulating frame in order for prevention from looseness. Further, after a plug and a socket connectors butt, elastic clips of each of the power terminals provided by the plug connector may be used to increase solid contact points and area in order to reduce resistance of the contact points, and heat dissipation capability during operate may be improved with heat sinkers for each of the power terminals. Furthermore, convection may be improved by means of heat dissipation holes and heat dissipation channel opened on the insulating frame in order to prevent poor heat dissipation issue generated after mounting on a circuit board.

In order to achieve above objective, the present invention is an improved plug, socket connector and the combination structure thereof, which includes:

a plug connector, comprising: an insulating frame, of which one end surface is provided with a butt slot, of which another end surface is provided with a limiting area, and the insulating frame being provided with multiple first and second containing troughs communicating the butt slot and the limiting area, each first containing trough being provided with a hook buckle in the limiting area on two sides thereof, and the insulating frame being provided with multiple heat dissipation holes through the butt slot, first and second containing troughs; multiple power terminals, which are provided in each of the first containing troughs in an one to one correspondence match, respectively, comprising respectively a slab, multiple elastic clips provided on one end of the slab and extending in the butt slot, multiple welding portions provided on the bottom of the slab and protruding out from the bottom surface of the insulating frame, a hook hole provided on the slab and joining with the hook buckles, and two heat sinkers provided on the other end of the slab and one side of each of the elastic clips, respectively; and multiple signal terminals, which are provided respectively in the second containing troughs of the insulating frame, one ends thereof extending in the butt slot, the other end thereof protruding out from the bottom surface of the insulating frame.

a socket connector, which butts with the plug connector, comprising: an insulating frame, one end surface thereof being provided with a bonding portion plugged with the butt slot, the another end surface thereof being provided with a limiting area, and the insulating frame having multiple first and second containing troughs communicating the bonding portion and the limiting area, each first containing trough being provided with one hook buckle in the limiting area on two sides thereof, and the insulating frame being provided with multiple heat dissipation holes through the limiting area, first and second containing troughs thereon; multiple power terminals, which are provided respectively in each first containing trough in an one to one correspondence match, comprising respectively a slab, a plugging portion provided on one end of the slab and contacting with each elastic clip, multiple welding portions provided on the bottom of the slab and protruding out from the bottom surface of the insulating frame, a hook hole provided on the slab and joining with the hook buckles, and a heat sinker provided on the other end of the slab; and multiple signal terminals, which are bonded respectively with each signal terminal of the plug connector, one ends thereof being provided respectively in the second containing trough of the insulating frame, the other end thereof protruding out from the bottom surface of the insulating frame.

In said embodiment, the limiting area of the insulating frame provided by the plug and socket connectors are composed of one extending portion provided on the top of the another end surface on the insulating frame, and multiple partition plates provided on the bottom of the another end surface on the insulating frame and corresponding to the extending portion.

In said embodiment, the bottom surface of the extending portion is provided with multiple slots, and rabbets corresponding to each of the slots are provided between the partition plates, respectively, for the top and the bottom of the slabs of each of the power terminals to join in the slots and the rabbets, respectively.

In said embodiment, the extending portion is provided with multiple heat dissipation holes corresponding to the slots thereon.

In said embodiment, each of the elastic clips comprises a connecting portion connecting with the slab, a bending portion connecting with the connecting portion, and a protruding portion connecting with the bending portion.

In said embodiment, each of the signal terminals provided by the plug connector comprises a plugging portion extending in the butt slot, a intervening portion connecting with the plugging portion and limited in the second containing trough, a bending portion connecting with the intervening portion, and a welding portion connecting with the bending portion and protruding out from the bottom surface on the insulating frame.

In said embodiment, each of the signal terminals provided by the socket connector comprises a clamping portion extending in the second containing trough, an intervening portion connecting with the clamping portion and limited to the insulating frame, a bending portion connecting with the intervening portion, and a welding portion connecting with the bending portion and protruding out from the bottom surface of the insulating frame, respectively.

In said embodiment, the intervening portion is a wide and flat slab.

DETAILED DESCRIPTION OF THE PREFERRED EMBODIMENTS

In order for understanding the objectives, features, and effects of the present invention fully, the present invention is described in detail as below by means of the following embodiments in conjunction with attached drawings.

Refer to FIGS. 1 to 10, which are a stereo appearance schematic showing the plug connector according to the present invention, a stereo exploded schematic showing the plug connector according to the present invention, a stereo appearance schematic showing the plug connector from another perspective according to the present invention, a stereo exploded schematic showing the plug connector from another perspective according to the present invention, a stereo appearance schematic showing the socket connector according to the present invention, a stereo exploded schematic showing the socket connector according to the present invention, a stereo appearance schematic showing the socket connector from another perspective according to the present invention, a stereo exploded schematic showing the socket connector from another perspective according to the present invention, a schematic showing a state in which the plug connector is joined with the socket connector according to the present invention, and a cross-sectional schematic showing a state in which the plug connector is joined with the socket connector according to the present invention. As shown in the figures, the present invention is an improved plug connector, socket connector and the combination structure thereof, which are composed of at least one plug connector 1 and one socket connector 2.

Figure 1:
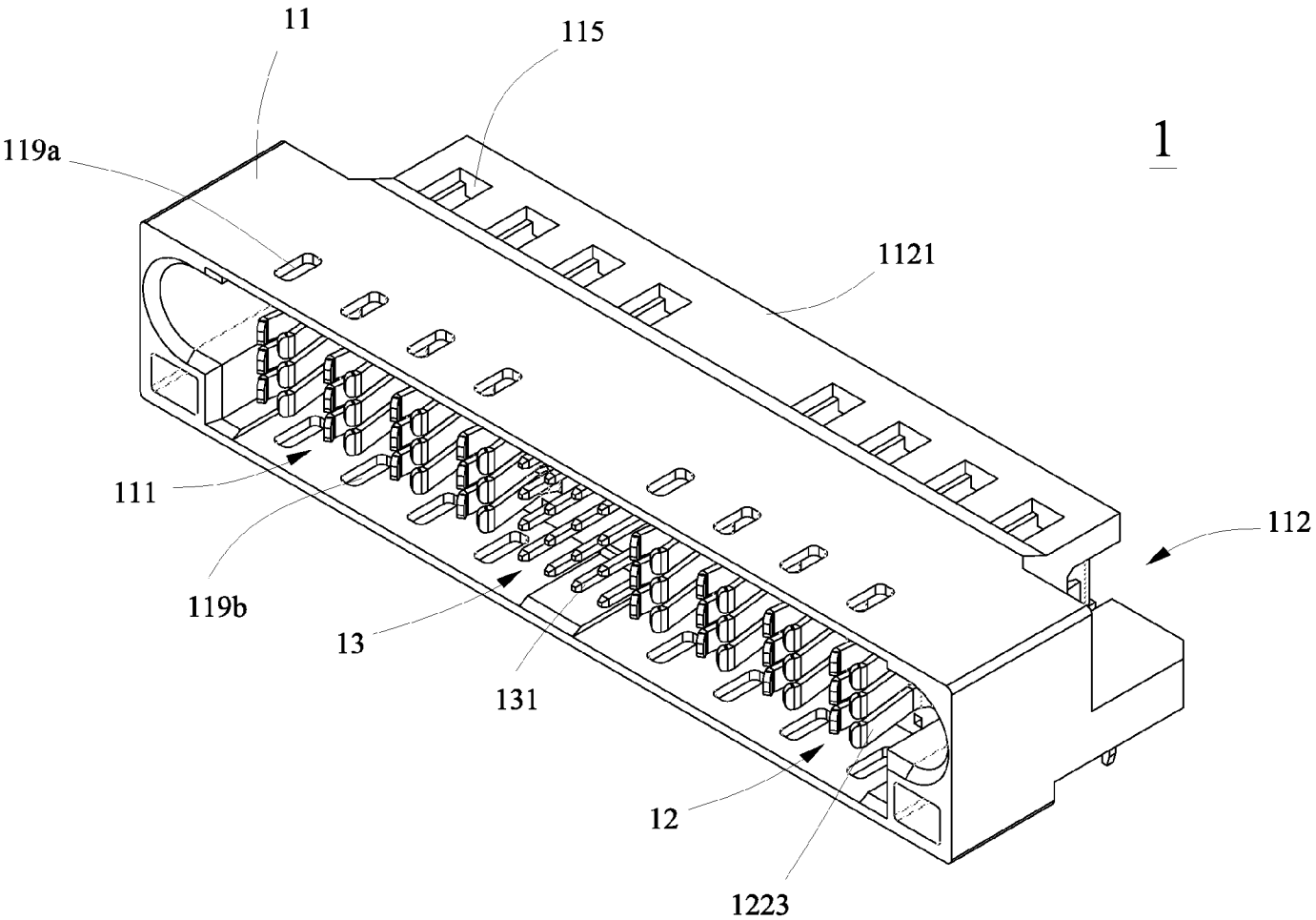
FIG. 1 is a stereo appearance schematic showing a plug connector according to the present invention.
Figure 2:
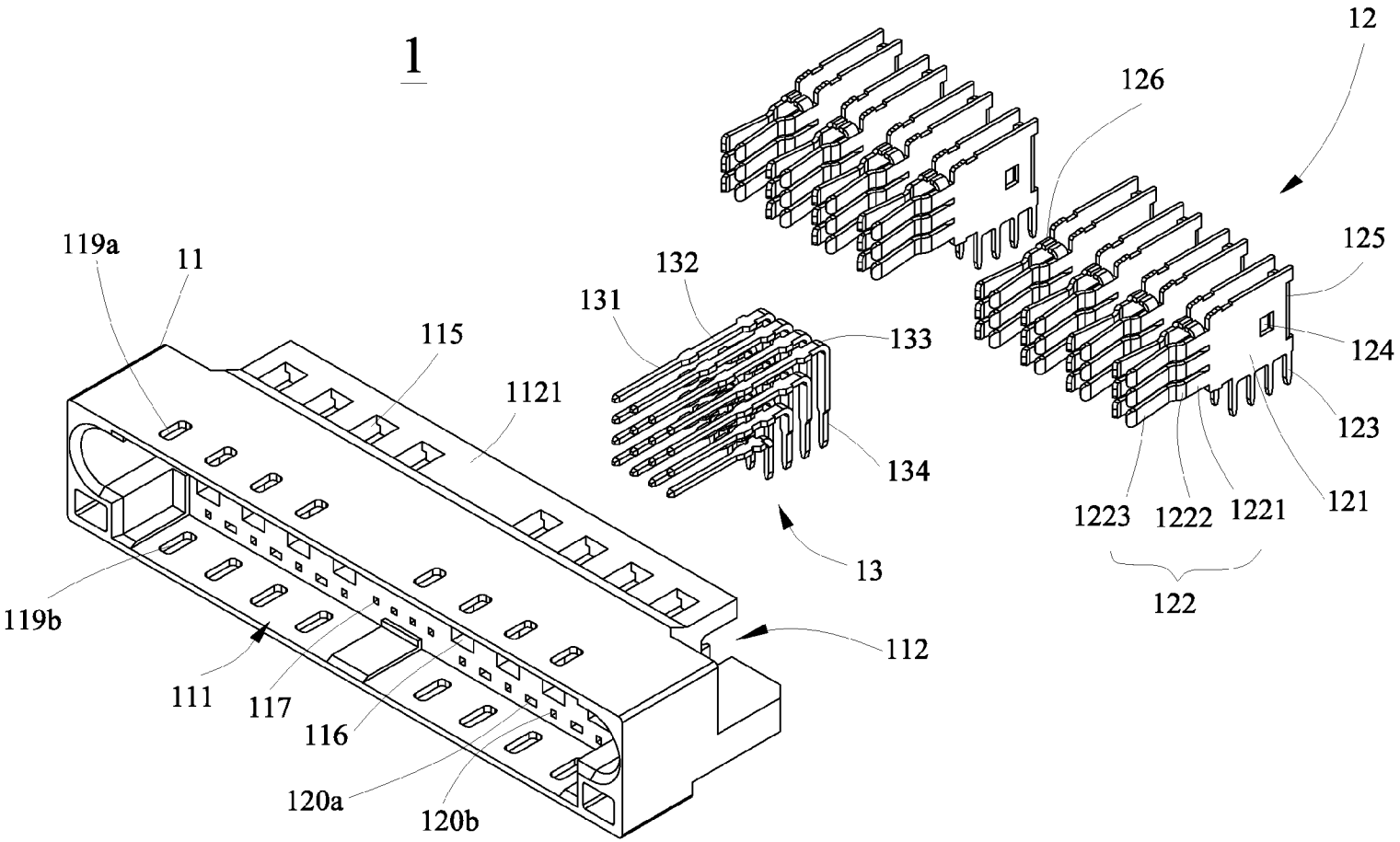
FIG. 2 is a stereo exploded schematic showing a plug connector according to the present invention.
Figure 3:
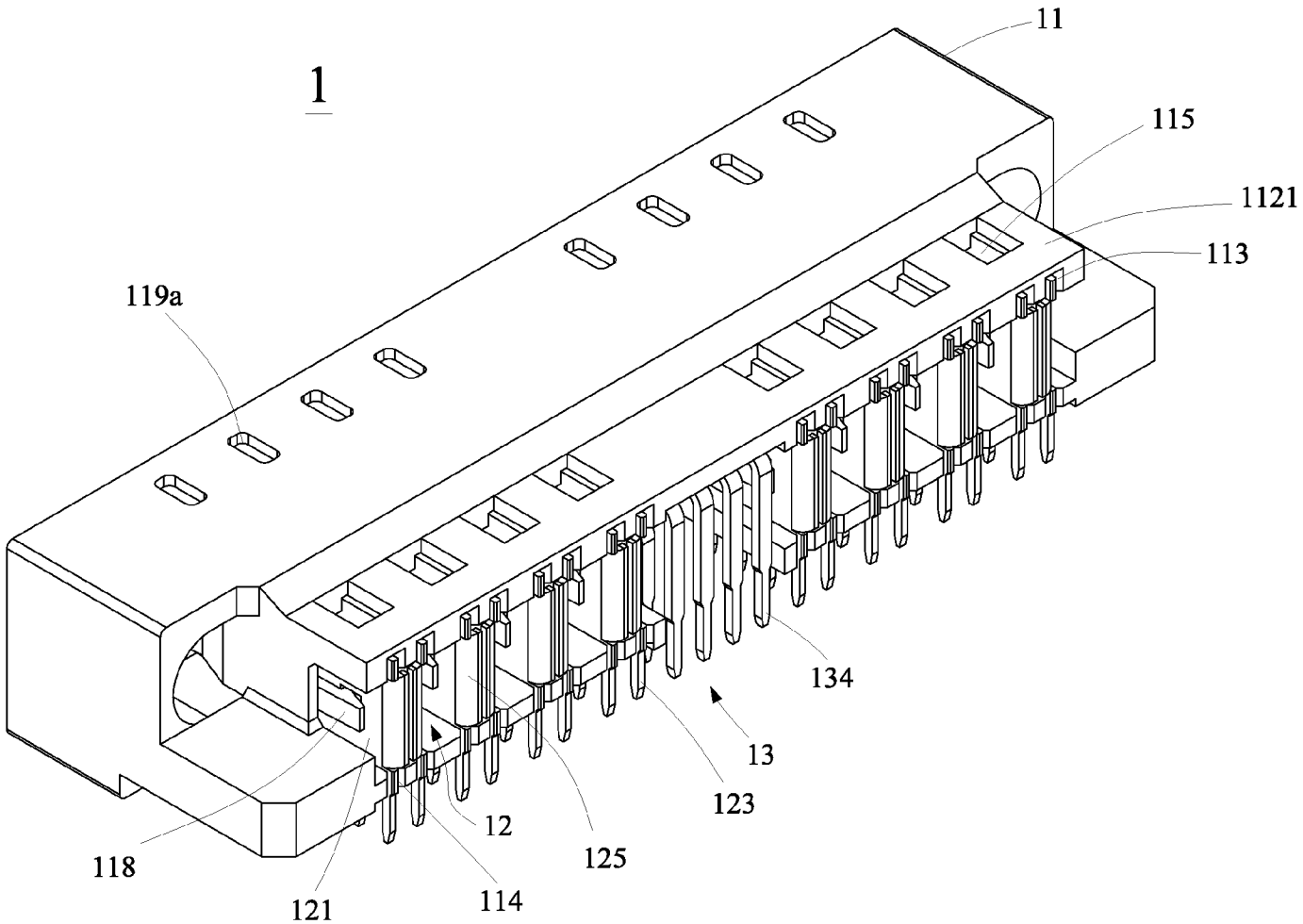
FIG. 3 is a stereo appearance schematic showing a plug connector from another perspective according to the present invention.
Figure 4:
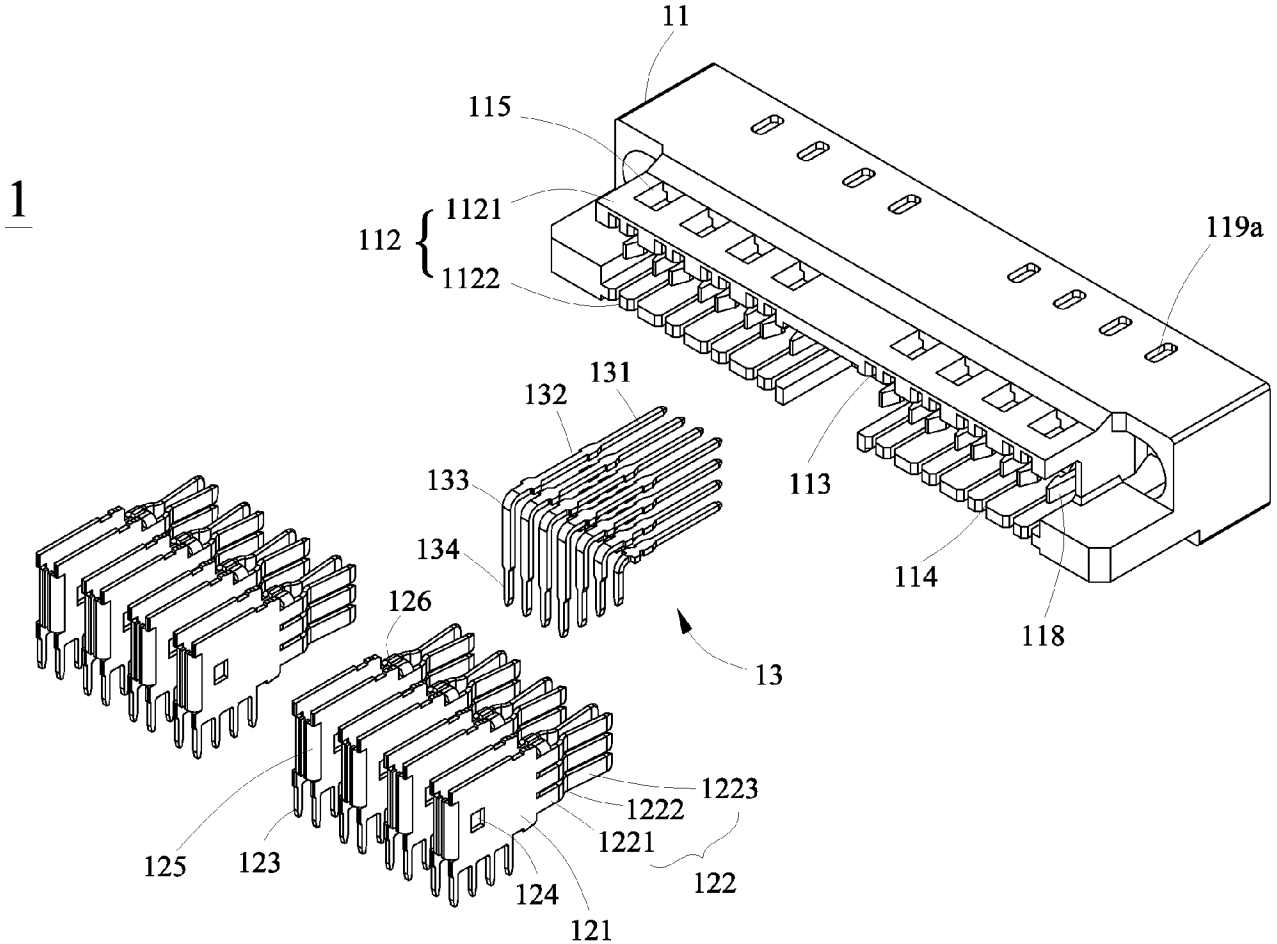
FIG. 4 is a stereo exploded schematic showing a plug connector from another perspective according to the present invention.
Figure 5:
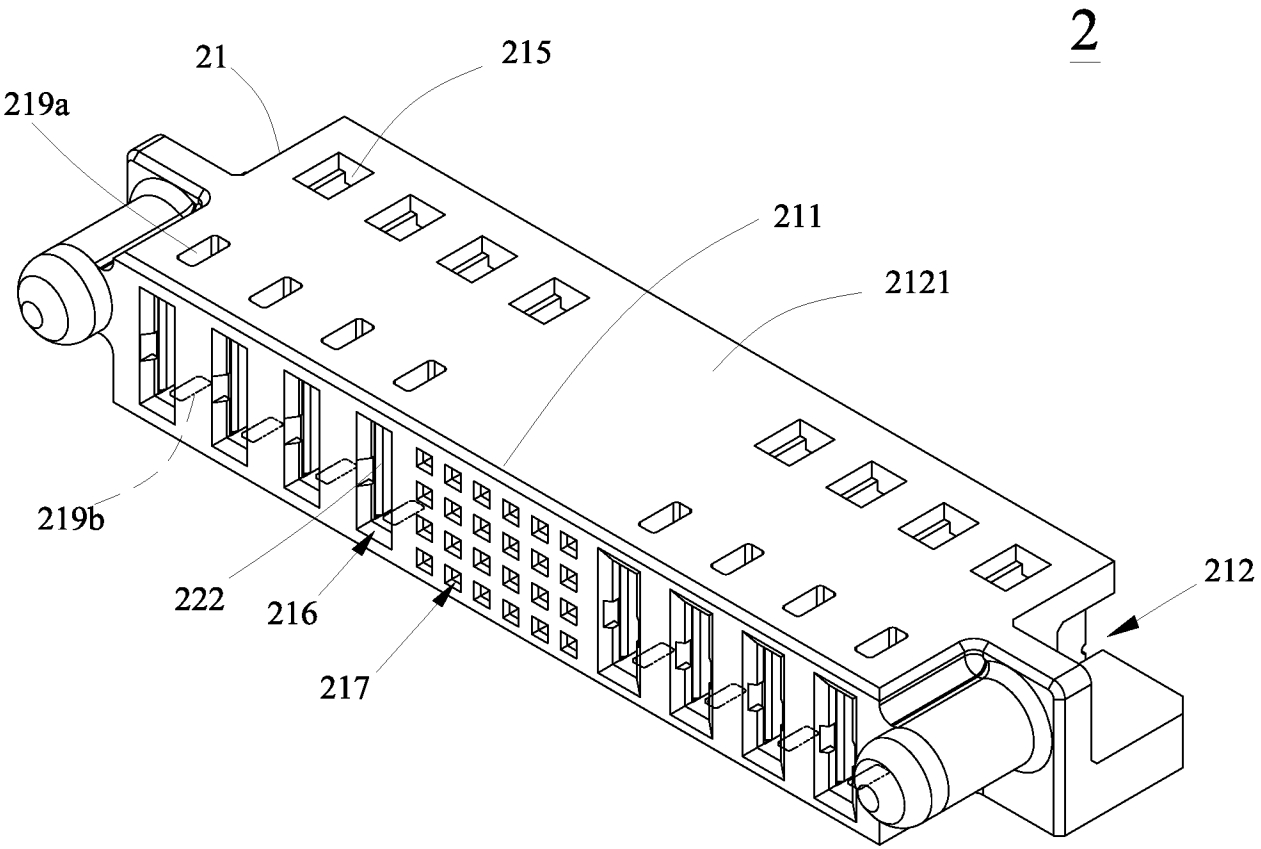
FIG. 5 is a stereo appearance schematic showing a socket connector according to the present invention.
Figure 6:
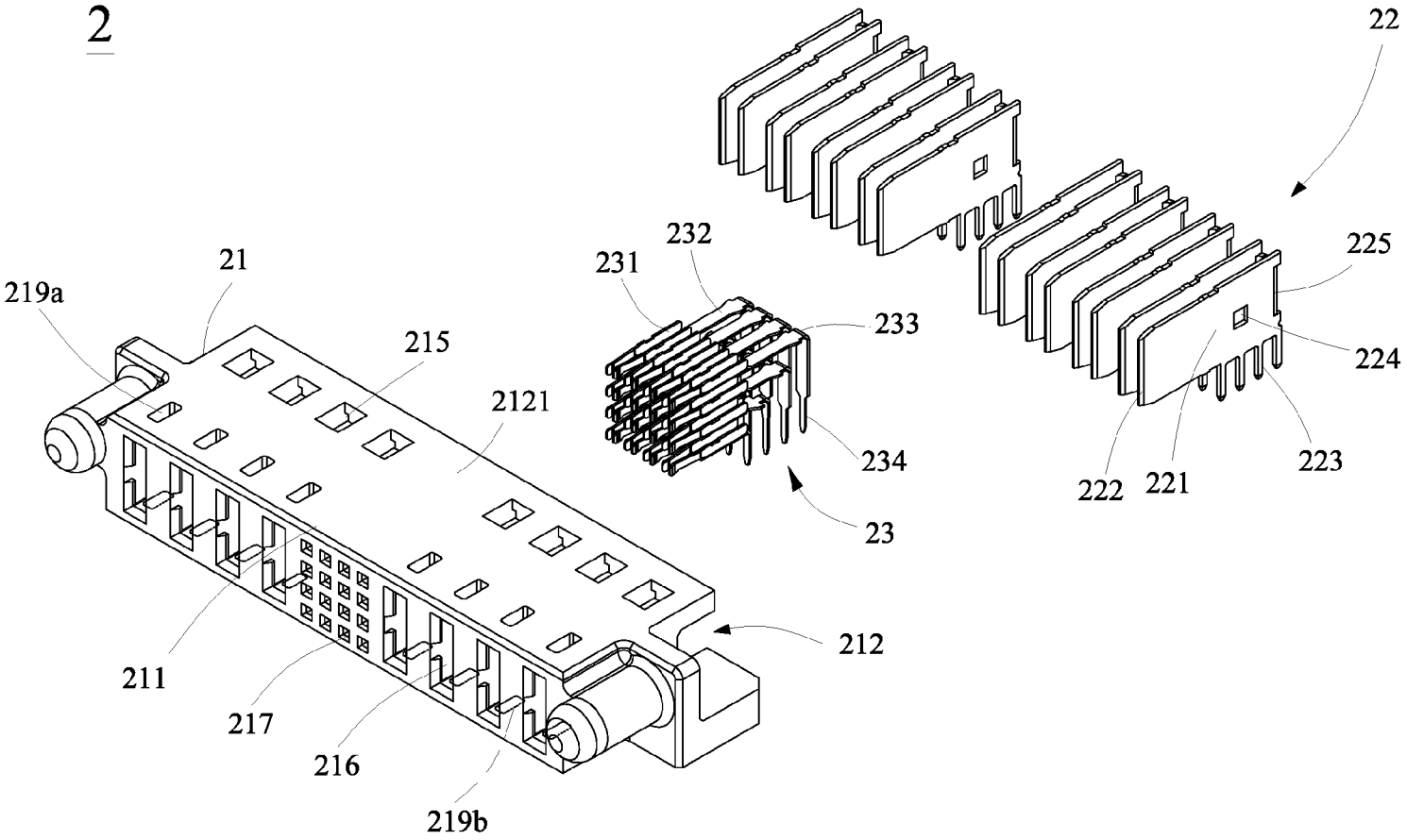
FIG. 6 is a stereo exploded schematic showing a socket connector according to the present invention.
Figure 7:
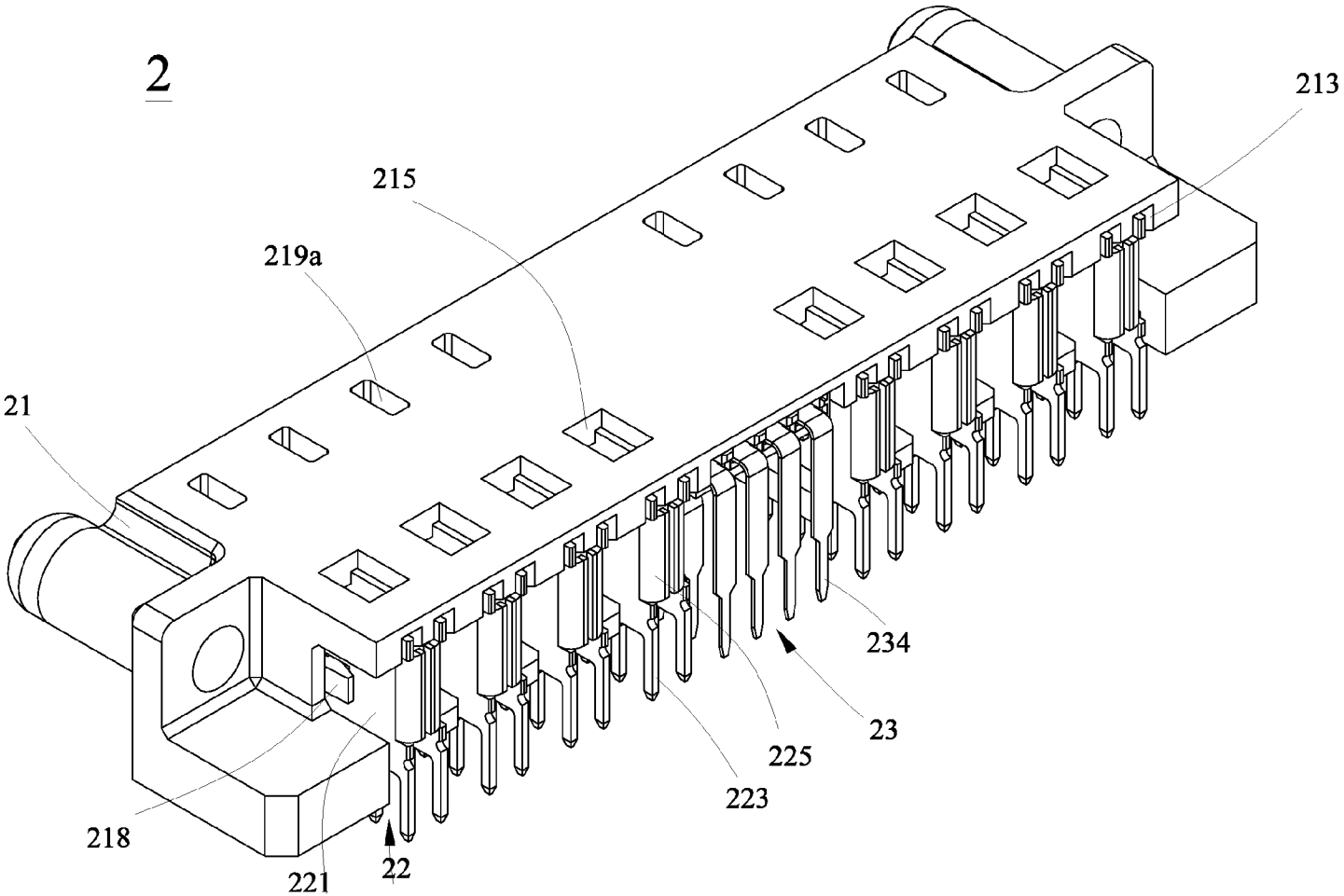
FIG. 7 is a stereo appearance schematic showing a socket connector from another perspective according to the present invention.
Figure 8:
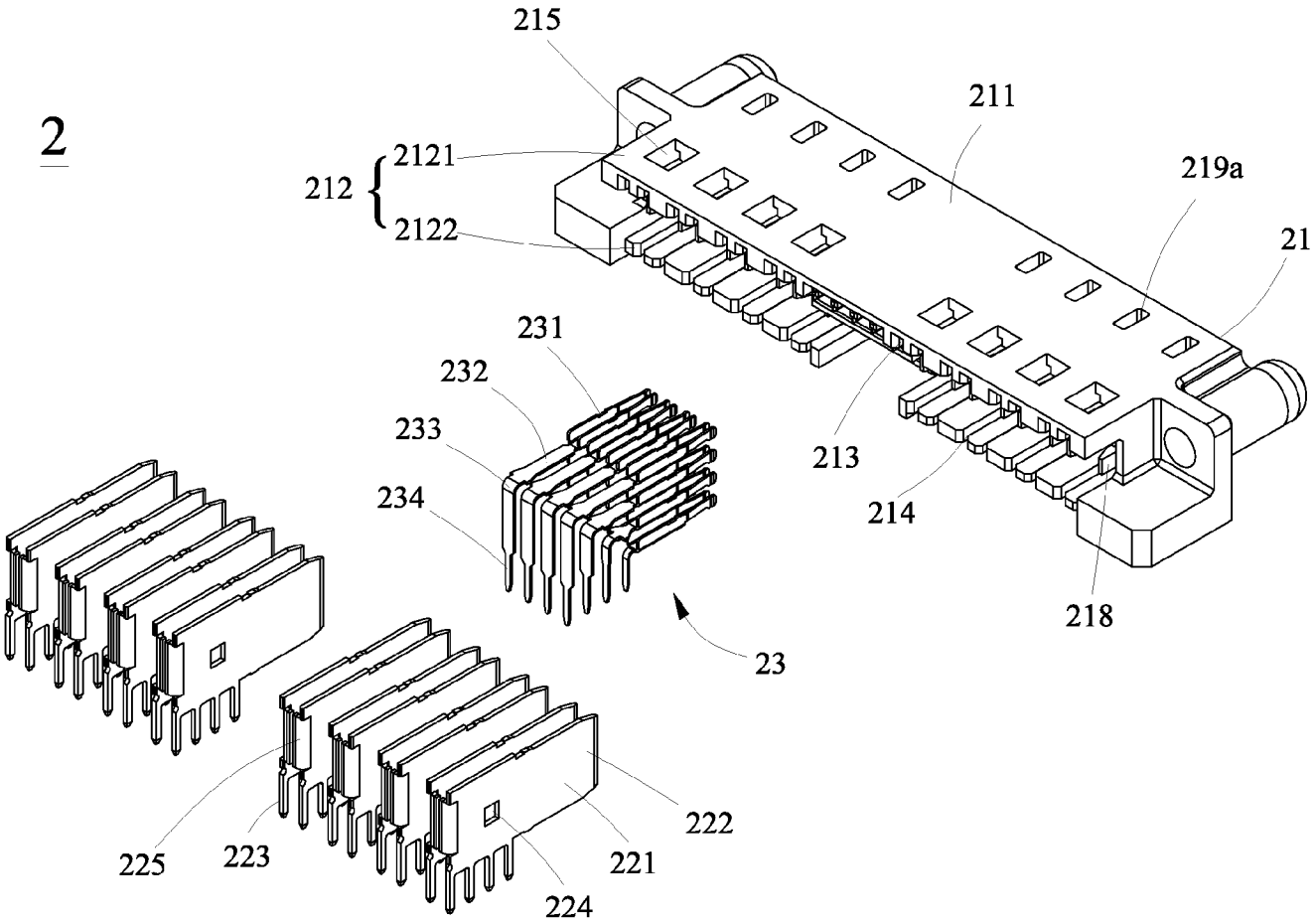
FIG. 8 is a stereo exploded schematic showing a socket connector from another perspective according to the present invention.
Figure 9:
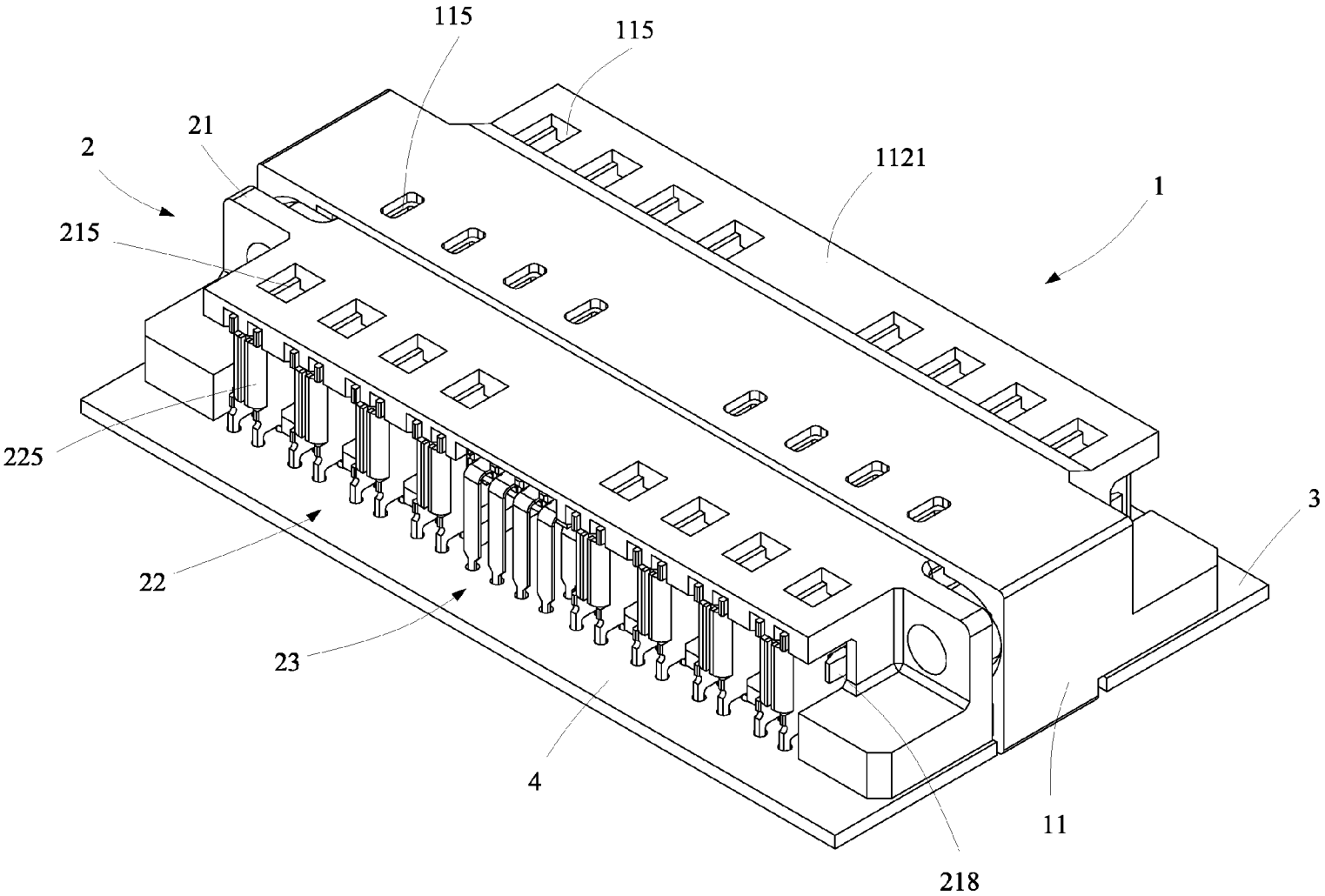
FIG. 9 is a schematic showing a state in which a plug connector is joined with a socket connector according to the present invention.

Refer to FIGS. 1 to 4, the above plug connector 1 comprises an insulating frame 11, of which one end surface is provided with a butt slot 111, another end surface is provided with a limiting area 112. The limiting area 112 is composed of an extending portion 1121 provided on the top of the another end surface on the insulating frame 11, and multiple partition plates 1122 provided on the bottom of the another end surface on the insulating frame 11 and corresponding to the extending portion 1121, wherein the bottom surface on the extending portion 1121 is provided with multiple slots 113, while rabbet 114 corresponding to each of the slots 113 are provided between the partition plates 1122, respectively, Also, multiple heat dissipation holes 115 corresponding to the slots 113 are provided on the extending portion 1121, and the insulating frame 11 is provided with multiple first and second containing troughs 116, 117 communicating the butt slot 111 and the limiting area 112. Each of the first containing troughs 116 is provided with a hook buckles 118 in the limiting area 112 on two sides thereof, and the insulating frame 11 is provided with multiple heat dissipation holes 119*a*, 119*b*, 120*a*, 120*b* through the butt slot 111, first and second containing troughs 116, 117 thereon. Multiple power terminals 12 are provided in each of the first containing troughs 116 in an one to one correspondence match, respectively, which comprise a slab 121 with top and bottom joined in the slots 113 and the rabbet 114, respectively, multiple elastic clips 122 provided on one end of the slab 121 and extending in the butt slot 111, multiple welding portions 123 provided on the bottom of the slab 121 and protruding out from the bottom surface of the insulating frame 11, a hook hole 124 provided on the slab 121 and joining with the hook buckle 118, and two heat sinkers 125, 126 provided on the other end of the slab 121 and on upper side of each of the elastic clips 122, respectively. Furthermore, each of the elastic clips 122 comprises a connecting portion 1221 connected with the slab 121, a bending portion 1222 connecting with the connecting portion 1221, and a protruding portion 1223 connecting with the bending portion 1222. Moreover, multiple signal terminals 13 are provided in the second containing trough 117 of the insulating frame 11, one ends thereof extend in the butt slot 111, and the other ends thereof protrude out from the bottom surface of the insulating frame 11, wherein each of the signal terminals 13 comprises a plugging portion 131 extending in the butt slot 111, an intervening portion 132 connected with the plugging portion 131 and limited in the second containing trough 117, a bending portion 133 connected with the intervening portion 132, and a welding portion 134 connected with the bending portion 133 and protruding out from the bottom surface of the insulating frame 11, respectively Refer to FIGS. 5 to 8, the socket connector 2, which butts with the plug connector 1 (as shown in FIG. 9), comprises an insulating frame 21, of which one end surface is provided with a bonding portion 211, and another end surface is provided with a limiting area 212. The limiting area 212 is composed of an extending portion 2121 provided on the top of the another end surface of the insulating frame 21, and multiple partition plates 2122 provided on the bottom of the another end surface on the insulating frame 21 and corresponding to the extending portion 2121, wherein the bottom surface of the extending portion 2121 is provided with multiple slots 213, while rabbets 214 corresponding to each of the slots 213 are provided between the partition plates 2122. Also, multiple heat dissipation holes 215 corresponding to the slots 213 are provided on the extending portion 2121, and the insulating frame 21 is provided with multiple first and second containing troughs 216, 217 communicating the bonding portion 211 and the limiting area 212. Each of the first containing troughs 216 is provided with a hook buckle 218 in the limiting area 212 on two sides thereof, respectively, and the insulating frame 21 is provided with multiple heat dissipation holes 219*a*, 219*b* through the limiting area 212, first and second containing troughs 216, 217 thereon. Multiple power terminals 22 are provided in each of the first containing troughs 216 in an one to one correspondence match, respectively, which comprise a slab 221 with top and bottom joining in the slot 213 and rabbet 214, respectively, a plugging portion 222 provided on one end of the slab 221 and contacted with each of the elastic clips 122, multiple welding portions 223 provided on the bottom of the slab 221 and protruded out from the bottom surface of the insulating frame 21, a hook hole 224 provided on the slab 221 and joining with the hook buckle, and a heat sinker 225 provided on the other ends of the slab 221, respectively. Moreover, multiple signal terminals 23 are bonded with each of the signal terminals 13 of the plug connector 1, respectively, of which one ends are provided in the second containing troughs 217 of the insulating frame 21, respectively, and the other ends protrude out from the bottom surface of the insulating frame 21. Furthermore, each of the signal terminals 23 comprises a clamping portion 231 extending in the second containing trough 217, an intervening portion 232 connected with the clamping portion 231 and limited to the second containing trough 217, a bending portion 233 connected with the intervening portion 232, and a welding portion 234 connecting with the bending portion 233 and protruding out from the bottom surface of the insulating frame 21, respectively. Also, the intervening portion 232 is a wide and flat slab.

Refer to FIGS. 2, 3, 6 and 7. Whenever each single-sheet power terminal 12, 22 is intended to join with the insulating frame 11, 21, each power terminal 12, 22 is provided in a first containing trough 116, 216 separately in an one to one correspondence match directly. Also, the top and bottom of its slab 121, 221 are joined in the slot 113, 213 and the rabbet 114, 214, respectively, for the hook hole 124, 224 of the slab 121, 221 and the hook buckle 118, 218 thereof to join. The joining of the hook hole 124, 224 and the hook buckle 118, 218 may be utilized to prevent each power terminal 12, 22 from the occurrence of looseness. Furthermore, whenever each single-sheet power terminal 12, 22 is intended to join with the insulating frame 11, 21, the welding portion 123, 223 on the bottom of each power terminal 12, 22 is protruded out from the bottom surface of the insulating frame 11, 21. Also, the elastic clips 122 of each power terminal 12 provided by the plug connector 1 extend in the butt slot 111, while a corresponding clamping state is formed between elastic clips 122 of each power terminal 12 provided by the plug connector 1.

Whenever each signal terminal 13, 23 is intended to join with the insulating frame 11, 21, each signal terminal 13, 23 is inserted into the second containing trough 117, 217 correspondingly. Thereby, each signal terminal 13, 23 is limited to the second containing trough 117, 217 with the intervening portion 132, 232 thereof, and the welding portion 134, 234 of each signal terminal 13, 23 is protruded out from the bottom surface of the insulating frame 11, 21 while the plugging portion 131 of each signal terminal 13 provided by the plug connector 1 is extended in the butt slot 111.

Figure 10:
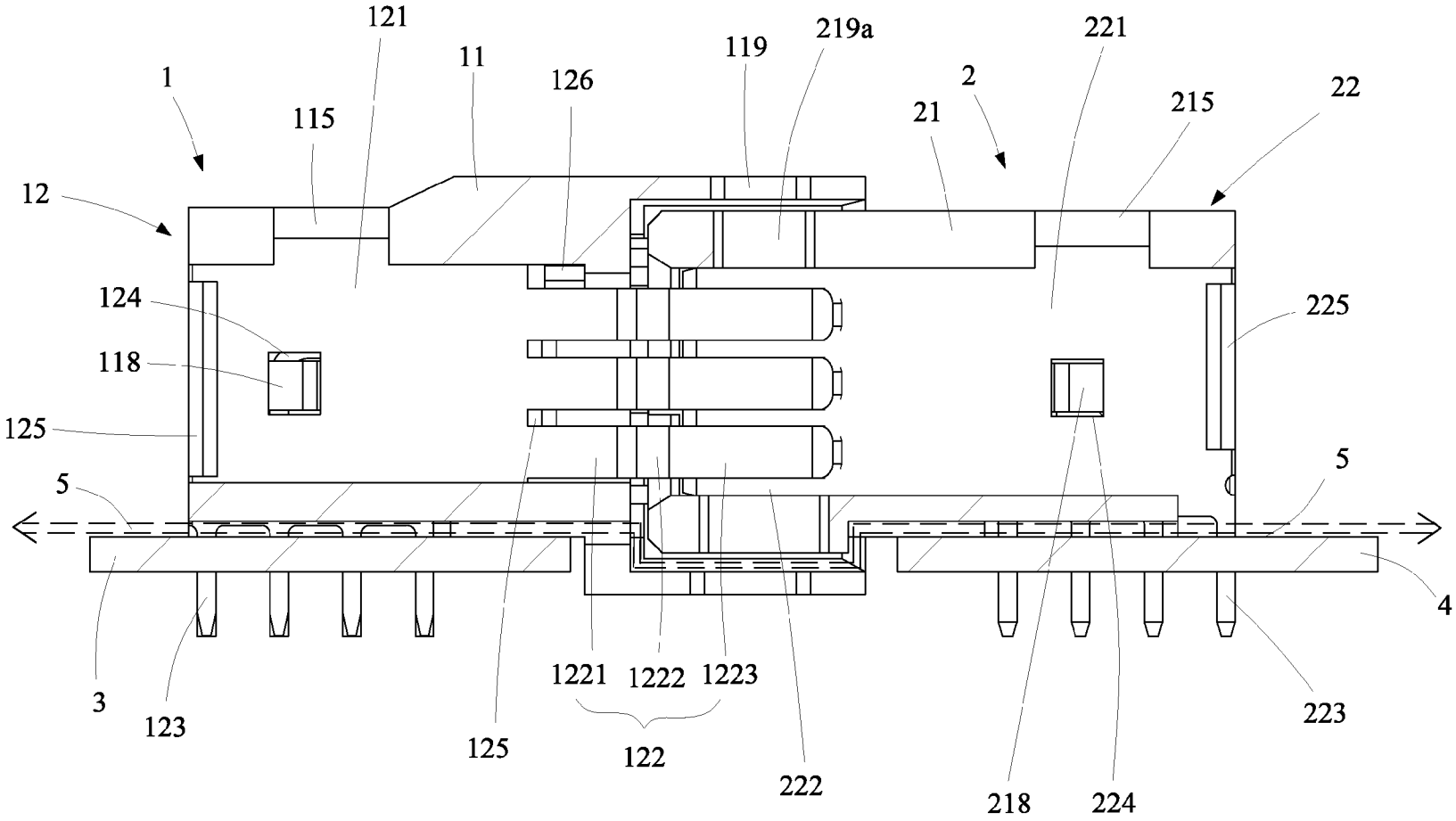
FIG. 10 is a cross-sectional schematic showing a state in which a plug connector is joined with a socket connector according to the present invention.
Figure 11:
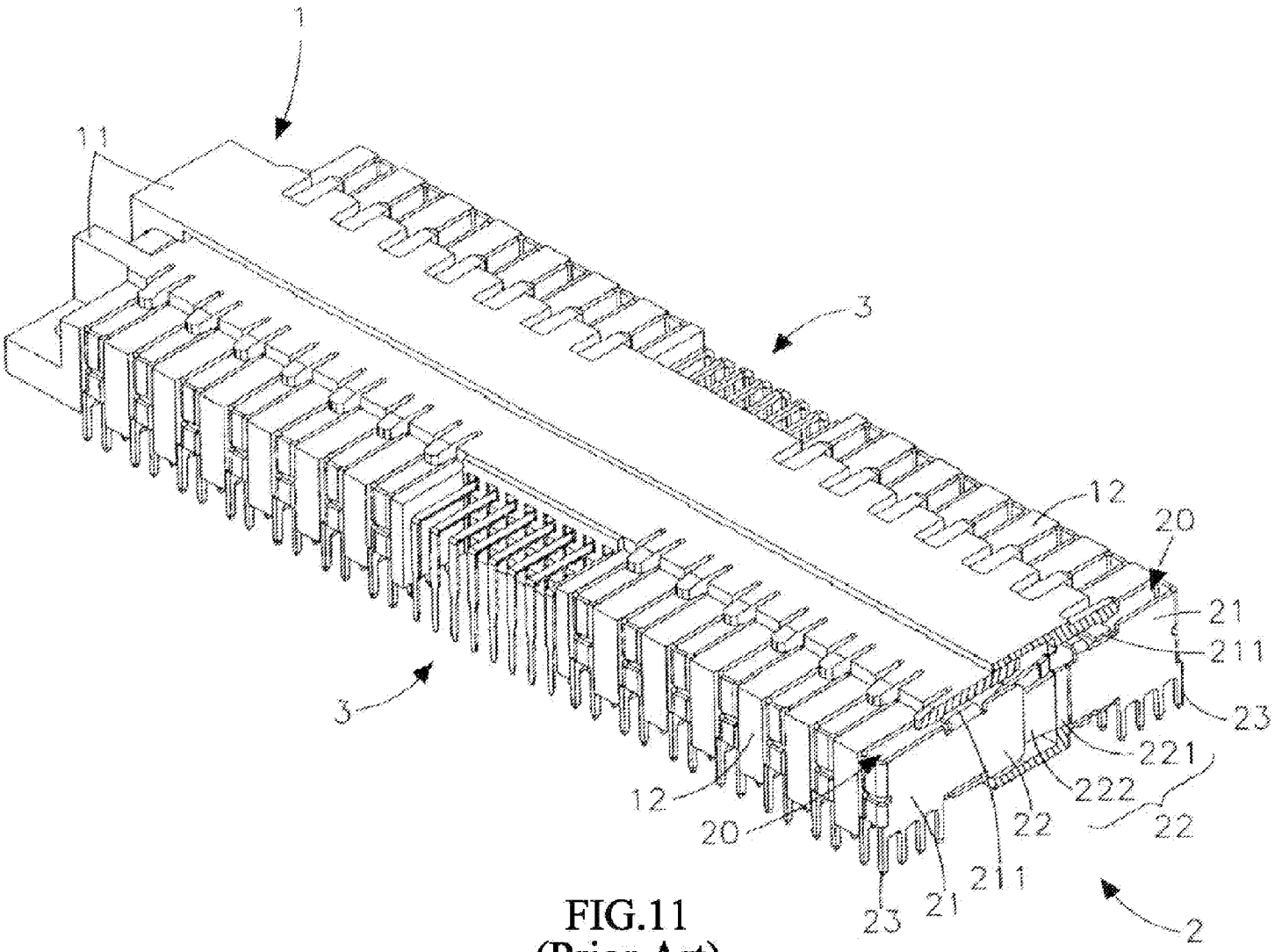
FIG.11 (Prior Art)
FIG. 11 is a schematic showing the plug connector, socket connector and the combination thereof according to Taiwan patent No. M420094.
Figure 12:
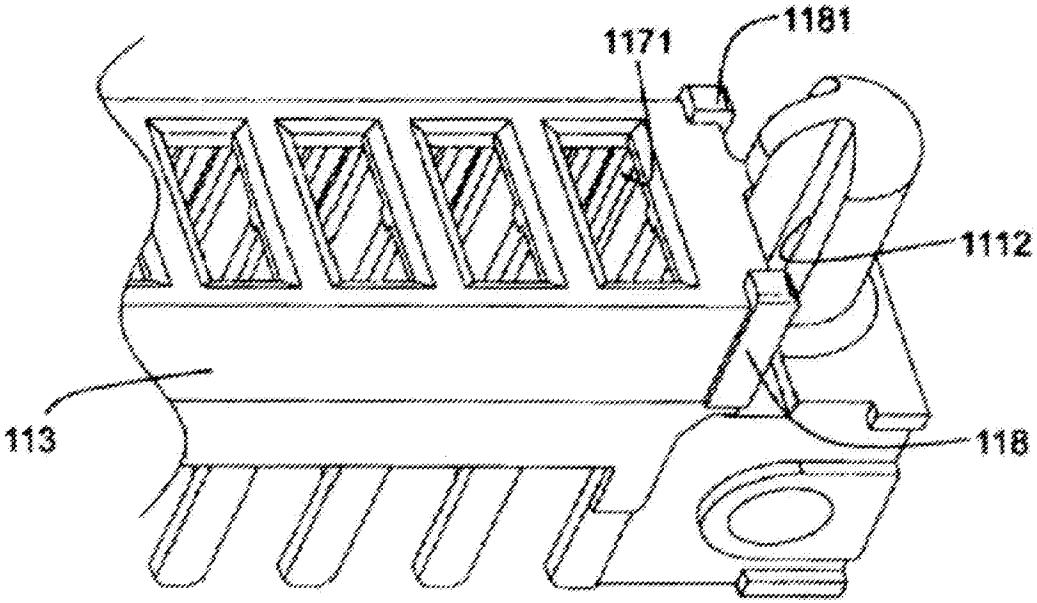
FIG.12 (Prior Art)
FIG. 12 is a schematic showing a power connector component and the connector therein according to Taiwan patent No. I350621.

Refer to FIGS. 9 and 10, during operation, each power terminal 12, 22 and each signal terminal 13, 23 provided by the plug connector 1 and the socket connector 2 is welded on one circuit board 3, 4 with the welding portion 123, 134, 223, 234 thereof, respectively, for the plug connector 1 and the socket connector 2 to butt with the butt slot 111 and the bonding portion 211 mutually, and for the plugging portion 222 of each power terminal 22 provided by the socket connector 2 to inserted between the elastic clips 122 forming corresponding clamping state simultaneously, while the plugging portion 131 of each signal terminal 13 provided by the plug connector 1 is inserted to the clamping portion 231 of each signal terminal 23 provided by the socket connector 2 to accomplish the connection of the plug connector 1 and the socket connector 2. Furthermore, as the plug connector 1 and the socket connector 2 are in use, the elastic clips 122 of each power terminal 12 provided by the plug connector 1 may be served to increase solid contact points and area of the plugging portion 222 in order to reduce resistance of the contact points, in addition to reduce resistance and elevated temperature which can be accomplished by means of the wide and flat intervening portion 232 of each signal terminal 23.

As the plug connector 1 and the socket connector 2 are in use, each heat sinker 125, 225 on each power terminal 12, 13 may be served simultaneously to improve the heat dissipation capability during use.

Additionally, as the plug connector 1 and the socket connector 2 are operating, the heat dissipation holes 115, 119*a*, 119*b*, 120*a*, 120*b*, 215, 126, 219*a*, 219*b* provided by each insulating frame 11, 21 may be served to improve convection in order to prevent poor heat dissipation issue generated after being mounted and used on the circuit board 3, 4. Moreover, whenever the plug connector 1 and the socket connector 2 are mounted on the circuit boards 3, 4 to butt with, the heat dissipation holes 119*a*, 219*a* provided below each insulating frame 11, 21 form a heat dissipation channel 5 by means of mutually corresponding adaptation in order to improve convection between each insulating frame 11, 21 and each circuit board 3, 4. Thereby, the effect of convection for heat dissipation is achieved effectively. Also, the conventional poor heat dissipation problem of the conventional structure resulted from absence of convection for heat dissipation after mounting on a circuit board is solved.

In summary, according to the content disclosed above, the present invention does achieve the expected objectives of the invention by means of an improved plug, socket connector and the combination structure thereof for each power terminal to use the hook hole for joining with the hook buckle of the insulating frame in order for prevention of looseness. Moreover, after the plug and the socket connectors butt together, the elastic clips of each power terminal provided by the plug connector increase solid contact points and area to reduce resistance of the contact points. Also, the heat dissipation capability during use is enhanced with the heat sinker of each power terminal. Additionally, convection may be improved with the heat dissipation holes and heat dissipation channel opened by each insulating frame to prevent the poor heat dissipation issue generated after mounting on to a circuit board.

What is claimed is:

1. An improved plug connector structure, comprising:

an insulating frame provided with a butt slot on one end surface and a limiting area on another end surface, the insulating frame having multiple first and second containing troughs for communicating the butt slot with the limiting area, two sides for each of the first containing troughs being provided with a hook buckle in the limiting area, respectively, and multiple heat dissipation holes through the butt slot, first and second containing troughs being provided on the insulating frame;

multiple power terminals, which are provided in each of the first containing troughs in an one to one correspondence match, respectively, comprising a slab, multiple elastic clips provided on one end of the slab and extending in the butt slot, multiple welding portions provided on the bottom of the slab and protruding out from the bottom surface of the insulating frame, a hook hole provided on the slab and joining with the hook buckle, and two heat sinkers provided on the other end of the slab and one side of each of the elastic clips, respectively; and multiple signal terminals, which are provided in the second containing trough of the insulating frame, respectively, one ends thereof extending in the butt slot, and the other ends thereof protruding out from the bottom surface of the insulating frame.

2. The improved plug connector structure as claim 1, wherein the limiting area is composed of one extending portion provided on the top of the another end surface on the insulating frame, and multiple partition plates provided on the bottom of the another end surface on the insulating frame and corresponding to the extending portion.

3. The improved plug connector structure as claim 2, wherein the bottom surface of the extending portion is provided with multiple slots, and rabbets corresponding to each of the slots are provided between the partition plates, respectively, for the top and the bottom of the slabs of each of the power terminals to join in the slots and the rabbets, respectively.

4. The improved plug connector structure as claim 2, wherein the extending portion is provided with multiple heat dissipation holes corresponding to the slots thereon.

5. The improved plug connector structure as claim 1, wherein each of the elastic clips comprises a connecting portion connecting with the slab, a bending portion connecting with the connecting portion, and a protruding portion connecting with the bending portion.

6. The improved plug connector structure as claim 1, wherein each of the signal terminals comprises a plugging portion extending in the butt slot, a intervening portion connecting with the plugging portion and limited in the second containing trough, a bending portion connecting with the intervening portion, and a welding portion connecting with the bending portion and protruding out from the bottom surface on the insulating frame.

7. An improved socket connector structure, comprising:

an insulating frame provided with a bonding portion on one end surface and a limiting area on another end surface, the insulating frame having multiple first and second containing troughs for communicating the bonding portion with the limiting area, two sides for each of the first containing troughs being provided with a hook buckle in the limiting area, respectively, and multiple heat dissipation holes through the limiting area, first and second containing troughs being provided on the insulating frame;

multiple power terminals, which are provided in each of the first containing troughs in an one to one correspondence match, respectively, comprising a slab, a plugging portion provided on one end of the slab, multiple welding portions provided on the bottom of the slab and protruding out from the bottom surface of the insulating frame, a hook hole provided on the slab and joining with the hook buckle, and a heat sinker provided on the other end of the slab, respectively; and multiple signal terminals, of which one ends are provided in the second containing troughs of the insulating frame, respectively, and of which the other ends are protruded out from the bottom surface of the insulating frame.

8. The improved socket connector structure as claim 7, wherein the limiting area is composed of an extending portion provided on the top of the another end surface on the insulating frame, and multiple partition plates provided on the bottom of the another end surface on the insulating frame and corresponding to the extending portion.

9. The improved socket connector structure as claim 8, wherein the bottom surface of the extending portion is provided with multiple slots, and rabbets corresponding to each of the slots are provided between the partition plates, respectively, for the top and the bottom of the slabs of each of the power terminals to join in the slots and the rabbets, respectively.

10. The improved socket connector structure as claim 9, wherein the extending portion is provided with multiple heat dissipation holes corresponding to the slots thereon.

11. The improved socket connector structure as claim 7, wherein each of the signal terminals comprises a clamping portion extending in the second containing troughs, a intervening portion connecting with the clamping portion and limited in the second containing trough, a bending portion connecting with the intervening portion, and a welding portion connecting with the bending portion and protruding out from the bottom surface on the insulating frame.

12. The improved socket connector structure as claim 11, wherein the intervening portion is a wide and flat slab.

* * * * *